US007399241B1

(12) United States Patent
Thomas, Sr.

(10) Patent No.: US 7,399,241 B1
(45) Date of Patent: Jul. 15, 2008

(54) PITCH TRAINING SYSTEM

(76) Inventor: Robert L. Thomas, Sr., 1400 Redbush Rd., Akron, OH (US) 44320

( * ) Notice: Subject to any disclaimer, the term of this patent is extended or adjusted under 35 U.S.C. 154(b) by 0 days.

(21) Appl. No.: 11/490,272

(22) Filed: Jul. 21, 2006

(51) Int. Cl.
*A63B 69/00* (2006.01)

(52) U.S. Cl. ..... 473/455; 473/454; 473/422

(58) Field of Classification Search ..... 473/422, 473/431, 451, 454, 455; 273/371, 348
See application file for complete search history.

(56) References Cited

U.S. PATENT DOCUMENTS

| | | | | | |
|---|---|---|---|---|---|
| 2,113,899 | A * | 4/1938 | Oram | 473/455 |
| 3,157,399 | A * | 11/1964 | Gaudet | 473/455 |
| 3,206,196 | A | 9/1965 | Jackson | |
| 3,229,975 | A | 1/1966 | Tompkins et al. | |
| 3,727,069 | A * | 4/1973 | Crittenden et al. | 273/371 |
| 4,563,005 | A * | 1/1986 | Hand et al. | 473/455 |
| 4,763,903 | A * | 8/1988 | Goodwin et al. | 273/371 |
| 4,770,527 | A | 9/1988 | Park | |
| 4,830,369 | A | 5/1989 | Poitras | |
| 4,949,972 | A * | 8/1990 | Goodwin et al. | 473/455 |
| D311,031 | S | 10/1990 | Poitras | |
| 5,046,729 | A | 9/1991 | Yancey | |
| 5,333,855 | A | 8/1994 | Silin et al. | |
| 5,577,733 | A * | 11/1996 | Downing | 273/348 |
| 5,676,607 | A | 10/1997 | Stumpf | |
| 6,135,900 | A | 10/2000 | McGrath | |
| 6,159,113 | A * | 12/2000 | Barber | 473/454 |
| 7,066,845 | B2 * | 6/2006 | Joseph | 473/431 |
| 7,156,761 | B2 * | 1/2007 | Mesa | 473/451 |
| 2002/0052255 | A1 | 5/2002 | Trevino | |
| 2004/0180736 | A1 | 9/2004 | Majumdar | |
| 2004/0239915 | A1 | 12/2004 | Anderson et al. | |

* cited by examiner

*Primary Examiner*—Mitra Aryanpour

(57) ABSTRACT

A pitch training system for indicating whether a thrown baseball has passed through a strike zone includes a zone assembly for detecting a baseball passing through the zone assembly. The zone assembly indicates when the baseball passes through a strike zone as determined by the zone assembly. A backstop is aligned with and positioned a distance from the zone assembly. The backstop intercepts the baseball thrown through the zone assembly.

15 Claims, 5 Drawing Sheets

PITCH TRAINING SYSTEM

BACKGROUND OF THE INVENTION

1. Field of the Invention

The present invention relates to pitching trainers and more particularly pertains to a new pitching trainer for indicating whether a thrown baseball has passed through an indicated strike zone.

2. Description of the Prior Art

The use of pitching trainers is known in the prior art. The prior art commonly teaches a system for determining a placement and speed of a thrown ball but fail to provide an indicator of whether the ball passed through a predetermined area.

While these devices fulfill their respective, particular objectives and requirements, the need remains for a system that has certain improved features that indicate to a person throwing a baseball that the baseball has passed through a strike zone. Additionally, the system collects the baseball and returns it in the general direction from which the baseball was thrown.

SUMMARY OF THE INVENTION

The present invention meets the needs presented above by generally comprising a zone assembly for detecting a baseball passing through the zone assembly. The zone assembly indicates when the baseball passes through a strike zone as determined by the zone assembly. A backstop is aligned with and positioned a distance from the zone assembly. The backstop intercepts the baseball thrown through the zone assembly.

There has thus been outlined, rather broadly, the more important features of the invention in order that the detailed description thereof that follows may be better understood, and in order that the present contribution to the art may be better appreciated. There are additional feature of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
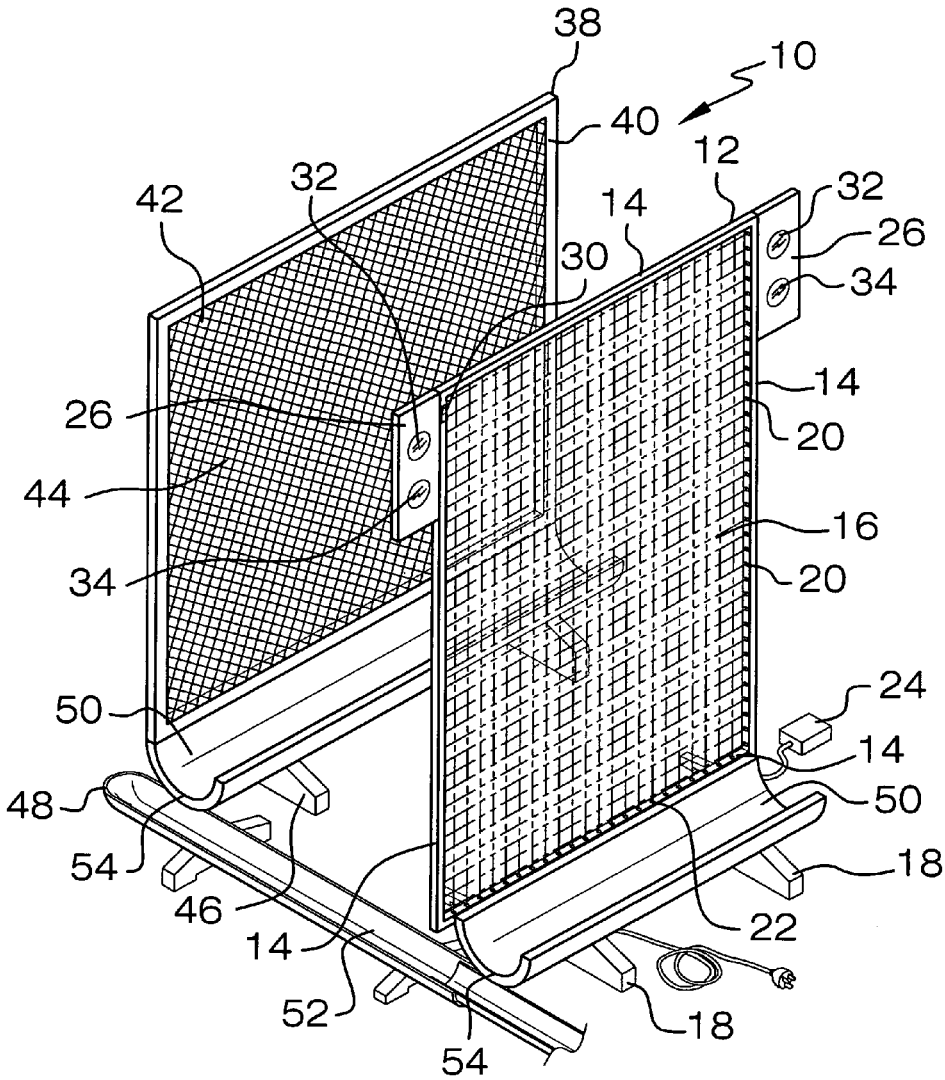
FIG. 1 is a perspective view of a pitch training system according to the present invention.
Figure 2:
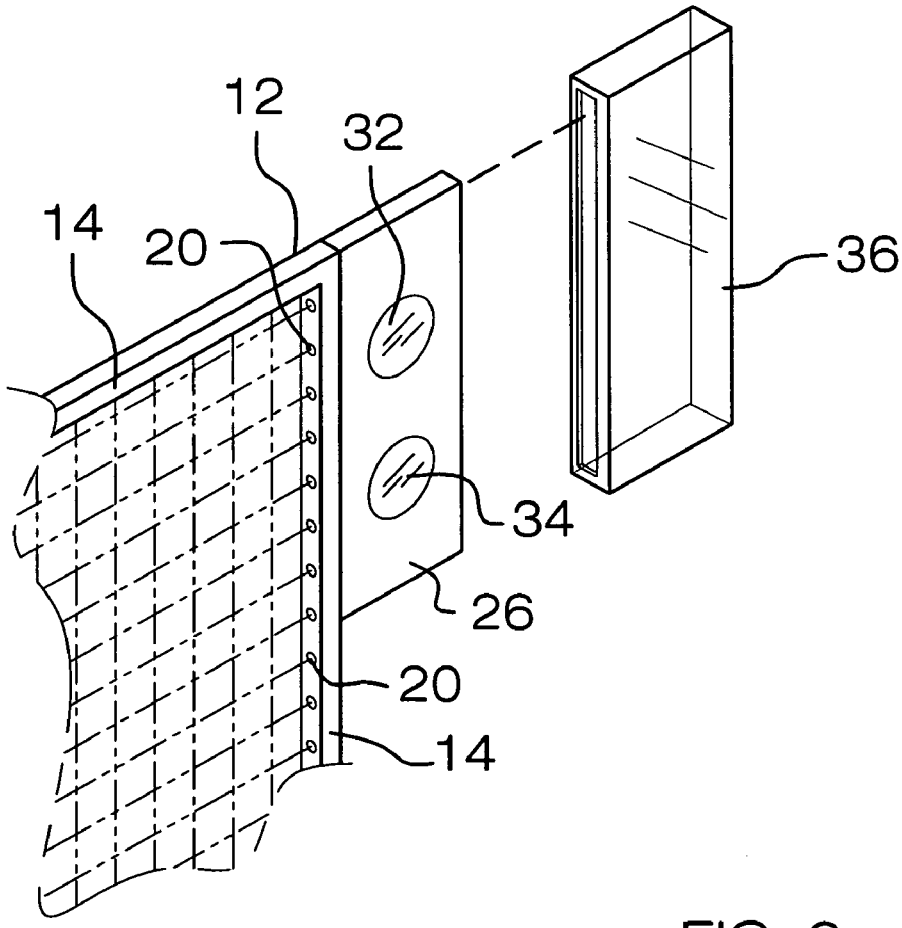
FIG. 2 is a perspective view of the shield of the present invention exploded away from the indicator housing.
Figure 3:
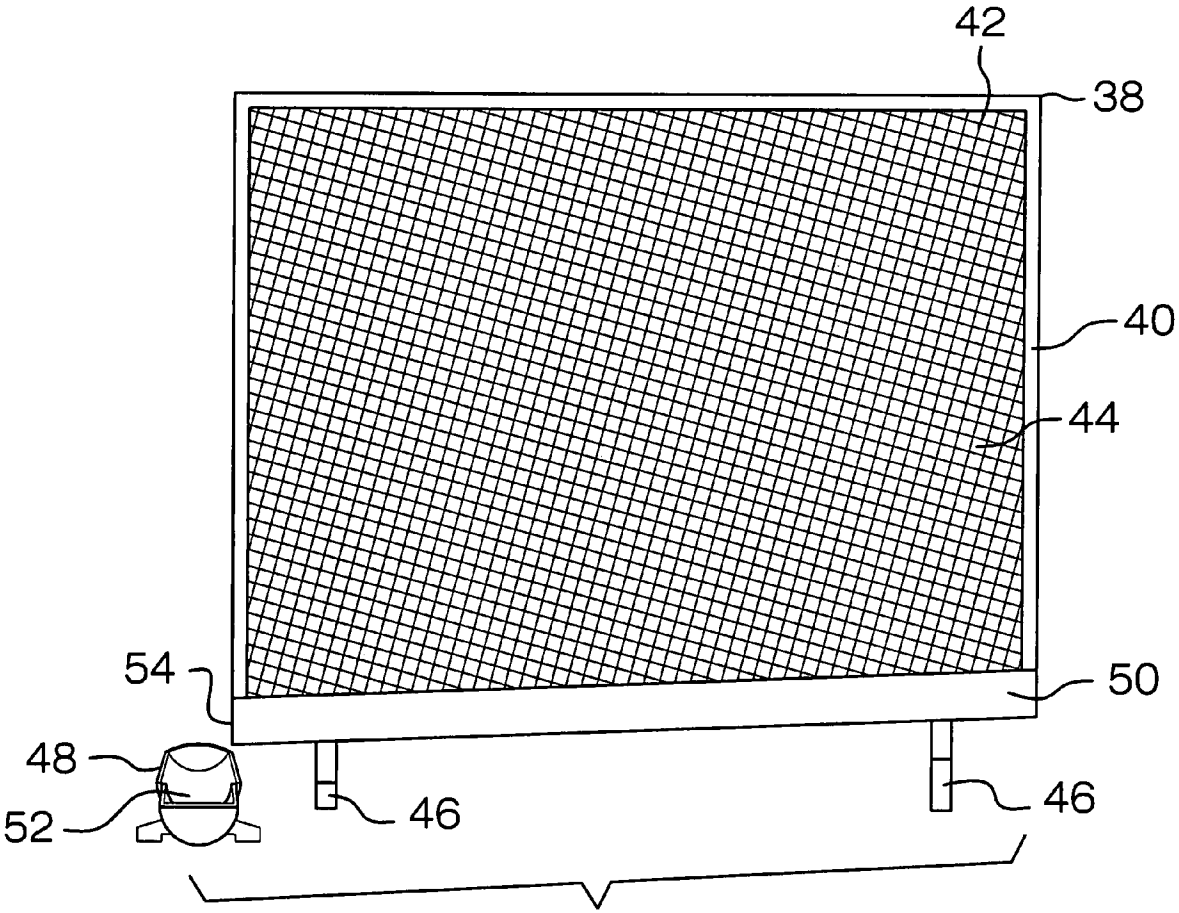
FIG. 3 is a front view of the backstop and ball return of the present invention.
Figure 4:
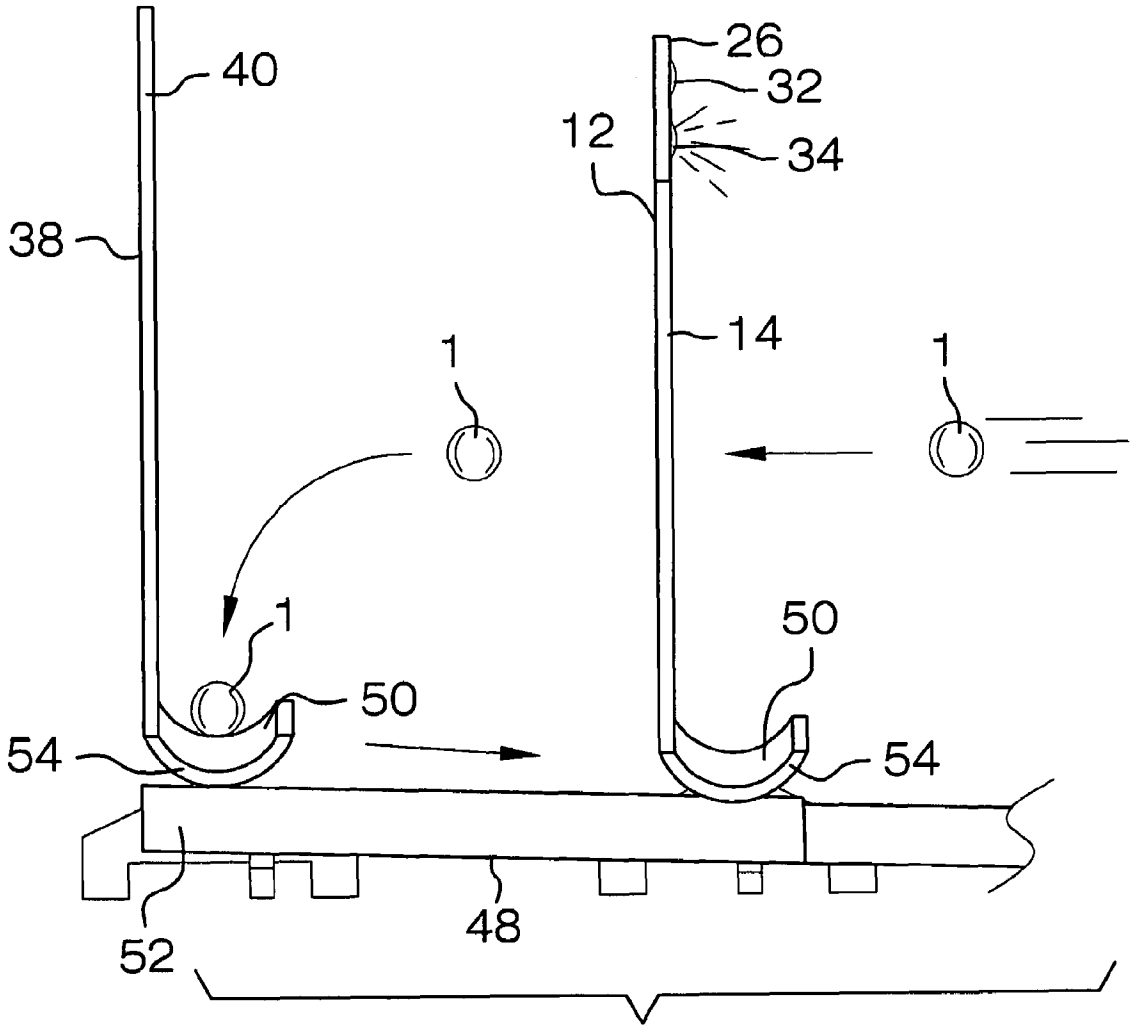
FIG. 4 is a side view of the present invention shown in use.
Figure 5:
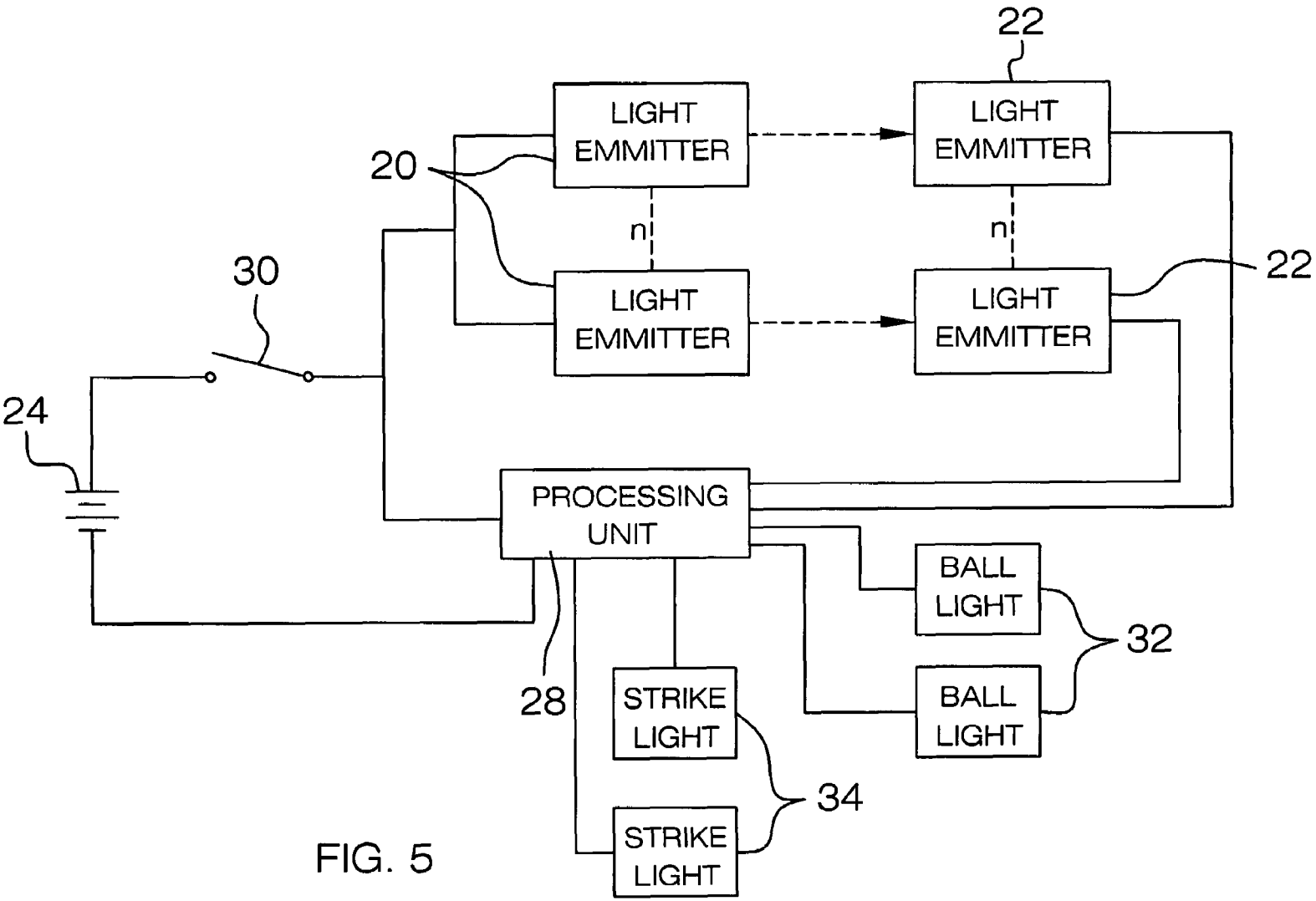
FIG. 5 is a schematic view of the present invention.

With reference now to the drawings, and in particular to FIGS. 1 through 5 thereof, a new pitching trainer embodying the principles and concepts of the present invention and generally designated by the reference numeral 10 will be described.

As best illustrated in FIGS. 1 through 5, the pitch training system 10 generally comprises a zone assembly 12 for detecting a baseball 1 passing through the zone assembly 12. The zone assembly 12 a indicates when the baseball 1 passes through a strike zone as determined by the zone assembly 12. The zone assembly 12 includes a plurality of frame portions 14 arranged in a substantially rectangular configuration. The frame portions 14 define an aperture 16 to permit the baseball 1 to pass between the frame portions 14. Each of a plurality of ground stabilizers 18 is coupled to one of the frame portions 14 and engages a ground surface to support the zone assembly 12 in a substantially vertical orientation.

The zone assembly 12 additionally includes a plurality of light emitters 20. The light emitters 20 are coupled to one of the frame portions 14 orientated vertically and one of the frame portions 14 orientated horizontally. Each of the light emitters 20 emit light across the aperture 16. The light emitter may comprise any range of devices that propagate a beam of electromagnetic radiation along a definable corridor, this may include, among others, visible and non-visible light waves and discreet frequencies of such (i.e. lasers). The beams propagated by the light emitters 20 form a grid of rows and columns extending across the aperture 16, wherein central intersections of the rows and columns define the strike zone.

Additionally, the zone assembly 12 includes a plurality of light sensors 22 coupled to the frame portions 14 and positioned opposite one of the light emitters 20. Each of the light sensors 22 detects the beam emitted by the associated one of the light emitters 20. A portion of the light sensors 22 sends a ball signal when the baseball 1 passes between the light emitters 20 and the light sensors 22. A power supply 24 is electrically coupled to and provides power to the light emitters 20 and the light sensors 22.

The zone assembly 12 also includes at least one indicator housing 26 coupled to one of the frame portions 14 opposite the aperture 16. A processing unit 28 is positioned in the at least one indicator housing 26 and is electrically coupled to each of the light sensors 22 and the power supply 24. The processing assembly receives signals from the portion of the light sensors 22 sending the ball signal. The processing unit 28 processes the ball signals to determine if the baseball 1 passes through the strike zone. A power switch 30 is coupled to the at least one indicator housing 26 and electrically coupled between the power supply 24 and the processing unit 28. The power switch 30 controls flow of power to the processing unit 28 when the power switch 30 is actuated.

The zone assembly 12 includes at least one ball light 32 coupled to the at least one indicator housing 26 and is electrically coupled to the processing unit 28. The at least one ball light 32 is illuminated by the processing unit 28 when the processing unit 28 determines the baseball 1 missed the strike zone. At least one strike light 34 is coupled to the at least one indicator housing 26 and electrically coupled to the processing unit 28. The at least one strike light 34 is illuminated by the processing unit 28 when the processing unit 28 determines the baseball 1 passed through the strike zone. The zone assembly 12 may also include at least one shield 36 positionable over the at least one indicator housing 26 to protect the at least one ball light 32 and the at least one strike light 34 from damage due to impact with the baseball 11. The at least one shield 36 is transparent to permit visibility through the at least one shield 36.

A backstop 38 is aligned with and positioned a distance from the zone assembly 12. The backstop 38 intercepts the baseball 1 thrown through the zone assembly 12. The backstop 38 includes a framework 40 having a substantially rectangular configuration and defining a hole 42 passing through the backstop 38. The backstop 38 includes a netting 44 coupled to the frame work and extending across the hole 42. The netting 44 stops the baseball 1 after the baseball 1 has passed through the zone assembly 12. The backstop 38 includes a plurality of foot portions 46 coupled to the framework 40. The foot portions 46 are positionable on the ground surface to support the framework 40 vertically from the ground surface.

A ball return 48 engages the backstop 38 and the zone assembly 12. The ball return 48 receives the baseball 1 thrown at the zone assembly 12 and returns the baseball 1 back towards the origination of the baseball 1. The ball return 48 includes a plurality of ramps 50. One of the ramps 50 is coupled to the zone assembly 12 to receive the baseball 1 when the baseball 1 falls adjacent to and in front of the zone assembly 12. One of the ramps 50 is coupled to the backstop 38 to receive the baseball 1 when the baseball 1 falls adjacent to and in front of the backstop 38. The ball return 48 includes a trough 52 positioned under an end 54 of each of the ramps 50. The trough 52 receives the baseball 1 from the ramps 50 and directs the baseball 1 back toward the origination of the baseball 1. The trough 52 is telescopic to permit a length of the trough 52 to be adjusted.

In use, the zone assembly 12 is positioned on the ground surface with the backstop 38 positioned a distance behind the zone assembly 12. The power switch 30 is actuated to permit power to be supplied to the light emitters 20 and the light sensors 22. As the baseball 1 is thrown through the aperture 16 of the zone assembly 12 the processing unit 28 determines which of the light sensors 22 failed to receive a beam from the light emitters 20 and determines if the baseball 1 passed through the strike zone. The processing unit 28 actuates the ball light 32 when the baseball 1 fails to pass through the strike zone and actuates the strike light 34 when the baseball 1 passes through the strike zone. The backstop 38 stops the baseball 1 once the baseball 1 has passed through the zone assembly 12. The ball return 48 receives the ball once the baseball 1 has been stopped by the backstop 38 and rolls the baseball 1 back towards the direction the baseball 1 was thrown from.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pitch training system for indicating when a baseball is thrown through a strike zone, said system comprising:

a zone assembly for detecting the baseball passing through said zone assembly, said zone assembly indicating when the baseball passes through a strike zone as determined by said zone assembly;

a backstop being aligned with and positioned a distance from said zone assembly, said backstop intercepting the baseball thrown through said zone assembly; and a ball return engaging said backstop and said zone assembly, said ball return receiving the baseball thrown at said zone assembly and returning the baseball back towards the origination of the baseball, said ball return including a plurality of ramps, one of said ramps being coupled to said zone assembly to receive the baseball when the baseball falls adjacent to and in front of said zone assembly, one of said ramps being coupled to said backstop to receive the baseball when the baseball falls adjacent to and in front of said backstop, said ball return including a trough positioned under an end of each of said ramps, said through receiving the baseball from said ramps and directing the baseball back toward the origination of the baseball, said trough being telescopic to permit a length of said trough to be adjusted.

2. The system according to claim 1, wherein said zone assembly includes a plurality of frame portions arranged in a substantially rectangular configuration, said frame portions defining an aperture to permit the baseball to pass between said frame portions.

3. The system according to claim 2, wherein said zone assembly includes a plurality of ground stabilizers, each of said ground stabilizers being coupled to one of said frame portions and engaging a ground surface to support said zone assembly in a substantially vertical orientation.

4. The system according to claim 2, wherein said zone assembly includes a plurality of light emitters, said light emitters being coupled to one of said frame portions orientated vertically and one of said frame portions orientated horizontally, each of said light emitters emitting light across said aperture.

5. The system according to claim 4, wherein said zone assembly includes a plurality of light sensors, each of said light sensors being coupled to said frame portions and positioned opposite one of said light emitters, each of said light sensors detecting the light emitted by the associated one of said light emitters, a portion of said light sensors sending a ball signal when the baseball passes between said light emitters and said light sensors.

6. The system according to claim 5, wherein said zone assembly includes a power supply being electrically coupled to and providing power to said light emitters and said light sensors.

7. The system according to claim 6, wherein said zone assembly includes at least one indicator housing being coupled to one of said frame portions opposite said aperture.

8. The system according to claim 7, wherein said zone assembly includes a processing unit being positioned in said at least one indicated housing and being electrically coupled to each of said light sensors and said power supply, said processing assembly receiving signals from said portion of said light sensors, said processing unit processing the signals to determine if the baseball passes through the strike zone.

9. The system according to claim 8, wherein said zone assembly includes at least one ball light being coupled to said at least one indicator housing and being electrically coupled to said processing unit, said at least one ball light being illuminated by said processing unit when said processing unit determines the baseball missed the strike zone.

10. The system according to claim 8, wherein said zone assembly includes at least one strike light being coupled to said at least one indicator housing and electrically coupled to said processing unit, said at least one strike light being illuminated by said processing unit when said processing unit determines the baseball passed through the strike zone.

11. The system according to claim 8, wherein said zone assembly includes a power switch being coupled to said at least one indicator housing and electrically coupled between said power supply and said processing unit, said power switch controlling flow of power to said processing unit when said power switch is actuated.

12. The system according to claim 1, wherein said backstop includes a framework having a substantially rectangular configuration and defining a hole passing through said backstop.

13. The system according to claim 12, wherein said backstop includes a netting being coupled to said frame and extending across said hole, said netting stopping the baseball after the baseball has passed through said zone assembly.

14. The system according to claim 12, wherein said backstop includes a plurality of foot portions being coupled to said framework, said foot portions being positionable on the ground surface to support said framework vertically from the ground surface.

15. A pitch training system for indicating when at baseball is thrown through a strike zone, said system comprising:

a zone assembly for detecting the baseball passing through said zone assembly, said zone assembly indicating when the baseball passes through a strike zone as determined by said zone assembly, said zone assembly comprising:

a plurality of frame portions being arranged in a substantially rectangular configuration, said frame portions defining an aperture to permit the baseball to pass between said frame portions;

a plurality of ground stabilizers, each of said ground stabilizers being coupled to one of said frame portions and engaging a ground surface to support said zone assembly in a substantially vertical orientation;

a plurality of light emitters, said light emitters being coupled to one of said frame portions orientated vertically and one of said frame portions orientated horizontally, each of said light emitters emitting light across said aperture;

a plurality of light sensors, each of said light sensors being coupled to said frame portions and positioned opposite one of said light emitters, each of said light sensors detecting the light emitted by the associated one of said light emitters, a portion of said light sensors sending a ball signal when the baseball passes between said light emitters and said light sensors;

a power supply being electrically coupled to and providing power to said light emitters and said light sensors;

at least one indicator housing being coupled to one of said frame portions opposite said aperture;

a processing unit being positioned in said at least one indicator housing and being electrically coupled to each of said light sensors and said power supply, said processing assembly receiving signals from said portion of said light sensors, said processing unit processing the signals to determine if the baseball passes through the strike zone;

at least one ball light being coupled to said at least one indicator housing and being electrically coupled to said processing unit, said at least one ball light being illuminated by said processing unit when said processing unit determines the baseball missed the strike zone;

at least one strike light being coupled to said at least one indicator housing and electrically coupled to said processing unit, said at least one strike light being illuminated by said processing unit when said processing unit determines the baseball passed through the strike zone, a power switch being coupled to said at least one indicator housing and electrically coupled between said power supply and said processing unit, said power switch controlling flower of power to said processing unit when said power switch is actuated;

a backstop being aligned with and positioned a distance from said zone assembly, said backstop intercepting the baseball thrown through said zone assembly; and a ball return engaging said backstop and said zone assembly, said ball return receiving the baseball thrown at said zone assembly and returning the baseball back towards the origination of the baseball, said ball return including a trough positioned under an end of each of said ramps, said trough receiving the baseball, said trough being telescopic to permit a length of said trough to be adjusted.

* * * * *